United States Patent [19]

Aylard et al.

[11] 3,939,297

[45] Feb. 17, 1976

[54] STOKER FEED SYSTEM

[75] Inventors: William F. Aylard, Northfield; Albert I. Blank, Lyndhurst, both of Ohio

[73] Assignee: Chase Brass & Copper Co., Incorporated, Cleveland, Ohio

[22] Filed: Dec. 7, 1973

[21] Appl. No.: 422,858

[52] U.S. Cl. ..... 13/29; 75/65 R; 214/18 SC; 214/18 V; 13/33; 266/33 R; 266/38

[51] Int. Cl.[2] ..... H05B 5/14; C21B 11/00

[58] Field of Search ..... 75/65 R; 266/27, 33 S, 266/33 R, 38; 214/18 SC, 18 V; 13/29, 33

[56] References Cited

UNITED STATES PATENTS

| | | | |
|---|---|---|---|
| 969,253 | 9/1910 | Diack | 75/65 R |
| 2,300,141 | 10/1942 | Whitzel | 75/65 R |
| 2,446,637 | 8/1948 | Crampton et al. | 13/29 X |
| 2,793,852 | 5/1957 | Harrison | 75/65 R X |
| 2,873,102 | 2/1959 | Tripmacher et al. | 75/65 R |
| 3,094,411 | 6/1963 | Triffleman | 75/65 R X |
| 3,137,569 | 6/1964 | Hammond et al. | 75/65 R X |
| 3,191,247 | 6/1965 | Holz | 266/38 X |
| 3,510,116 | 5/1970 | Harvill et al. | 266/38 |
| 3,556,500 | 1/1971 | Romulus et al. | 266/33 S |
| 3,589,699 | 6/1971 | Bogan | 266/38 X |
| 3,767,090 | 10/1973 | Sundberg et al. | 13/33 X |

*Primary Examiner*—Allen B. Curtis
*Assistant Examiner*—Thomas A. Waltz

[57] ABSTRACT

A stoker feed system and method for supplying metal to a melting furnace is disclosed wherein a generally vertically extending feed tube is mounted with its lower end portion submerged below the upper surface of molten metal in the furnace. The feed tube is in communication with at least one feed chute at its upper end portion through which a metal charge is supplied to the feed tube. An additional feed chute is also provided in communication with the upper end portion of the feed tube for supplying carbon to the feed tube. A column of metal chips and carbon is thus formed in the feed tube, and a piston, reciprocally mounted in the feed tube, compresses this column while moving the charge downwardly into the molten metal mass of the furnace.

11 Claims, 5 Drawing Figures

STOKER FEED SYSTEM

The present invention relates to stoker feed systems for supplying metal to a melting furnace and, more particularly, to a stoker feed system and method for supplying brass chips to a melting furnace.

The art of melting and forming metals contains a large variety of furnace structures and associated metal feeding systems. Typically, the metal feeding and stoking systems are associated with a single furnace by being integrally formed with the furnace or otherwise rigidly secured thereto. Accordingly, it is relatively difficult to repair and/or replace the metal feed and stoking systems. In addition, in numerous metal furnaces, particularly furnaces in which metal is reclaimed, undesirable gases are produced which tend to escape from the furnace through the feed system itself. For example, in the treatment of brass chips, zinc fumes escape from the furnace and, when contacted with air, create zinc oxides which exit from the furnace stack as an undesirable white cloud of dust. The escape of such gases is not only highly undesirable since they are typically air pollutants, or poisonous gases or explosive gases, but also in some cases, e.g. in the melting of brass chips, is an expensive wasting of a material which is necessary to the melting process. Accordingly, a variety of attempts have been made to prevent escape of undesirable gases from the furnace through the metal feeding and stoking systems of the prior art.

It is an object of the present invention to provide a metal feed and stoking system which is relatively simple in construction and which will limit and/or prevent the escape of undesirable gases from a furnace.

Yet another object of the present invention is to provide a compact stoker feed system for a melting furnace which can be readily separated from the furnace and transported to a remote station for repair or use in connection with another furnace.

Yet another object of the present invention is to provide a stoker feed system and method for operating the system which is economical in operation and durable in use.

In accordance with an aspect of the present invention a stoker feed system is provided for supplying free cutting brass chips to a melting furnace. Basically, the system consists of a feed tube which is removably mounted on the furnace and which has a lower end portion that is positioned to be submerged below the upper level of the molten metal in the furnace. Preferably, the lower end portion of the feed tube is a removable cylindrical tube member formed of cast iron or a metal alloy of special composition which is resistant to erosion by the molten metal in the furnace.

The feed tube is supplied at its upper end with the metal to be melted, e.g. free cutting brass chips. This charge can be supplied continuously or in separate measured charges. Preferably, the brass chips are supplied in conjunction with carbon beads or the like, either mixed with the charge, or continuously supplied therewith, or even as separate layers supplied to the top of each separate measured charge of metal chips. In either case the combined charge of chips and carbon beads forms a column of charge in the feed tube to a height well above the level of molten metal in the feed tube. This column of charge is pushed downwardly in the feed tube by a reciprocally operable piston, which serves to compress the charge and carbon beads while pushing the metal in the tube downwardly into the furnace. The column of brass chips and carbon bead charge forms a barrier in the feed tube which prevents undesirable gases from escaping therethrough.

The above, and other objects, features and advantages of the present invention will be apparent from the following detailed description of an illustrative embodiment thereof which is to be read in connection with the accompanying drawings, wherein.

Figure 1:
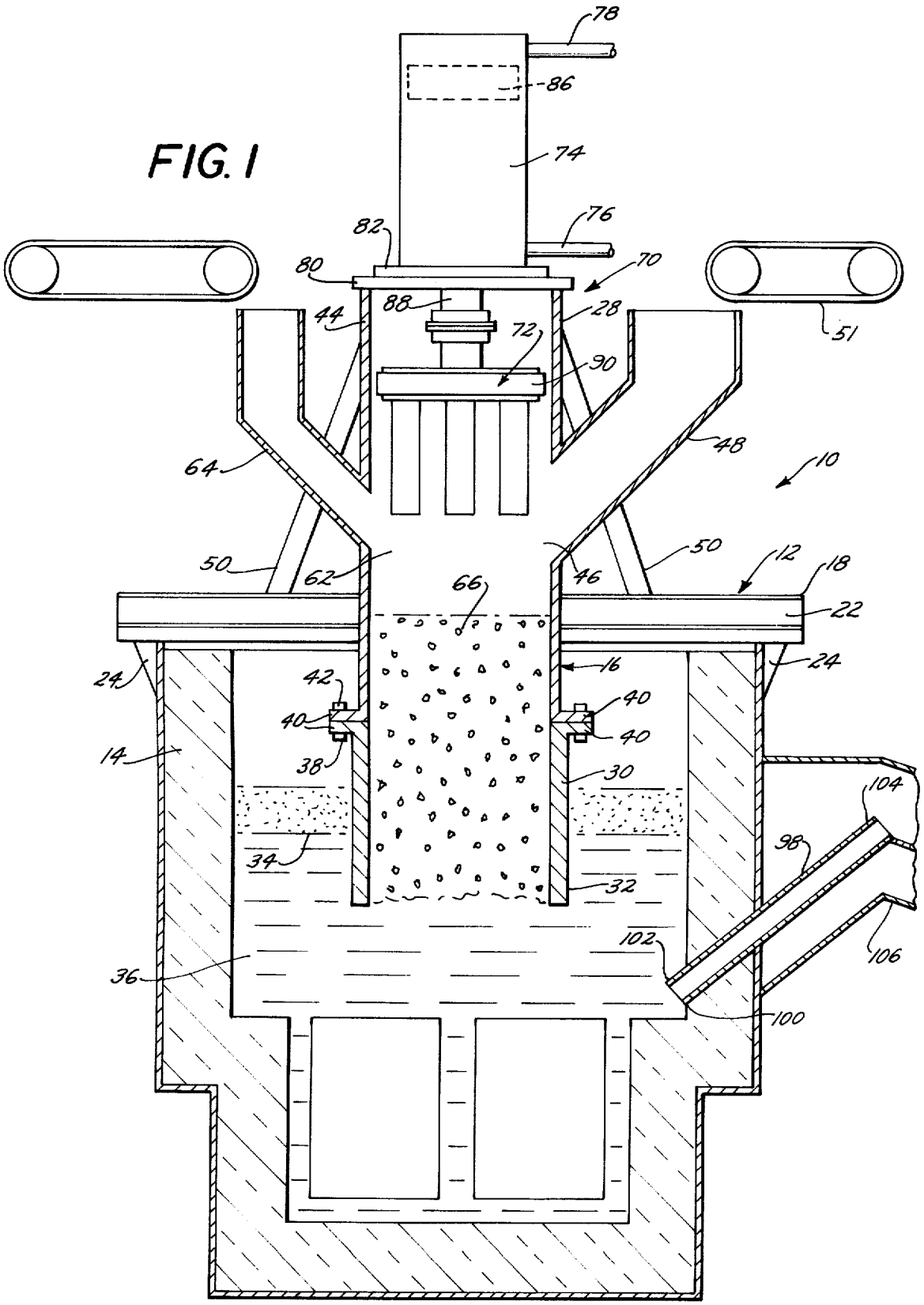
FIG. 1 is a schematic elevational view, partly in section, of a stoker feed system associated with a metal melting furnace and constructed in accordance with an embodiment of the present invention.

Referring now to the drawings in detail, and initially to FIG. 1 thereof, it will be seen that a metal stoker feed system 10, constructed in accordance with the present invention, includes a frame 12 which is mounted on a melting furnace 14. The furnace 14 is of conventional design and construction and can be either electrically heated or fuel fired. Preferably, however, the furnace 14 is an induction furnace of the type shown in FIG. 1 which will effect vigorous stirring of the molten metal to achieve effective melting of the metal chips.

Frame 12 provides mounting support for a central feed tube 16 which is connected to the frame in any convenient manner so as to be held rigidly in a relatively vertical position with respect to the level of the molten metal in the furnace. In this connection, frame 12 includes a base 18 having a plurality of beams which span the top opening 22 of the furnace and which are seated on the frame edge of the furnace. In addition, the stoker frame can be provided with end mounting plates 24 through which the frame is removably connected by bolts or the like to the furnace. In this manner the stoker frame, and the entire feed system 10, is removably mounted on furnace 14.

Feed tube 16 is formed of two axially aligned and interconnected pipes 28, 30 as seen most clearly in FIG. 1. Upper pipe or tube 28 forms the major portion of the length of feed tube 16 and preferably is formed of a heavy steel material. Lower feed tube 30, on the other hand, is relatively short, and has substantially the same interior diameter as the tube 28. Tube 30 may be formed of cast iron or an alloy of special composition which is resistant to erosion by the molten metal in the furnace, e.g. N2B alloy.

Figure 2:
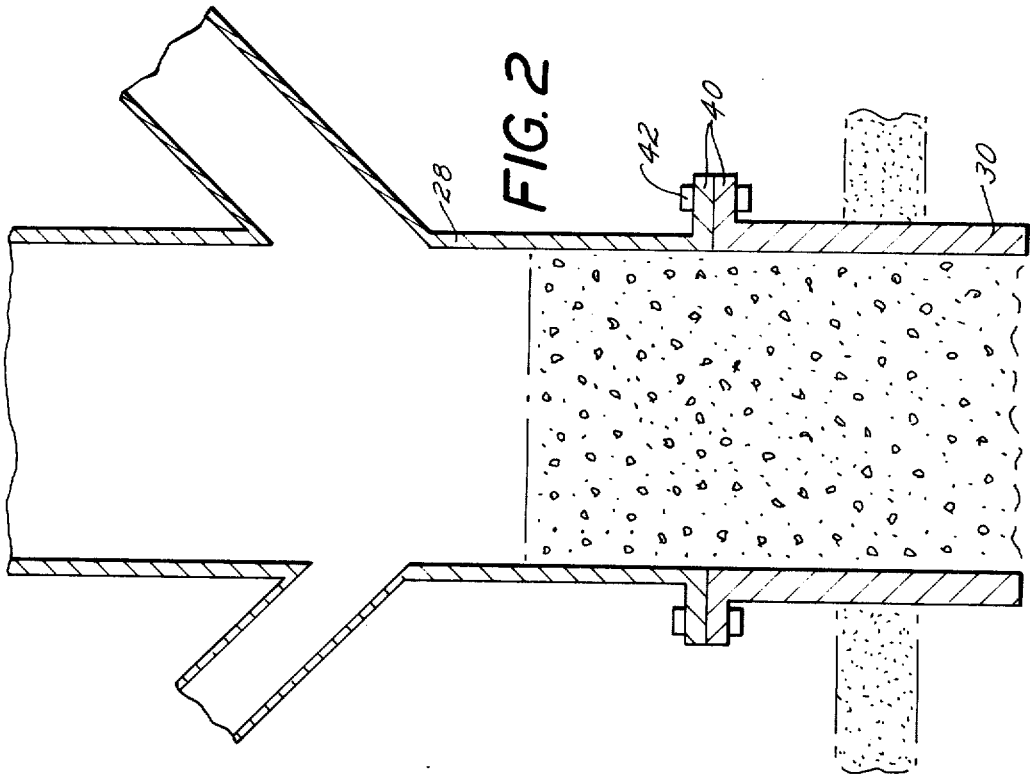
FIGS. 2 and 3 are enlarged partial schematic sectional views of the metal feed tube used in the stoker feed system illustrated in FIG. 1.

The length of tube 30 is selected so that its lower end 32 will be positioned below the top level 34 of molten metal 36 in furnace 14 (the level of metal 34 in the furnace is controlled in a manner described more fully hereinafter, while the top portion 38 of tube 30 is located adjacent the top of the furnace at a level to which the metal in the furnace will not rise. As illustrated in Fig. 2, tubes 28, 30 are operatively interconnected by a pair of flanges 40 secured thereto in any convenient manner, with the flanges being connected by a plurality of bolts 42 or the like. By this arrangement, tube 30 can be conveniently removed from tube 28 for repair or replacement in the event that becomes necessary, without disturbing the remainder of the elements in the stoker feed system.

The upper end portion 44 of feed tube 16 (more specifically the upper end portion of tube 28) has one or more openings 46 formed therein which are positioned in communication with metal feed chutes 48. These feed chutes, only one of which is illustrated in FIG. 1, are rigidly connected to tube 16, in any convenient manner, as for example by rivets or bolts. The chutes can be channel-shaped members or tubes as desired. In either case, chutes 48 are supported by brackets 50 on frame 12, as to be movable with the frame.

In the preferred embodiment of the invention, the stoker feed system 10 is used to supply free cutting brass chips to the furnace 14. These chips may, for example, be scrap chips produced in the manufacture by machining of brass screws or the like, and are supplied to the metal feed chute 48 in any convenient manner, as for example, by conveyors 51, metal buggys, etc. The metal charge may be supplied continuously to feed tubes 48 and thus to feed tube 16 or the tubes 48 may be provided with a gating system, as described hereinafter, to supply separate measured metal charges to feed tube 16 during each cycle of operation of the feed system.

Figure 3:
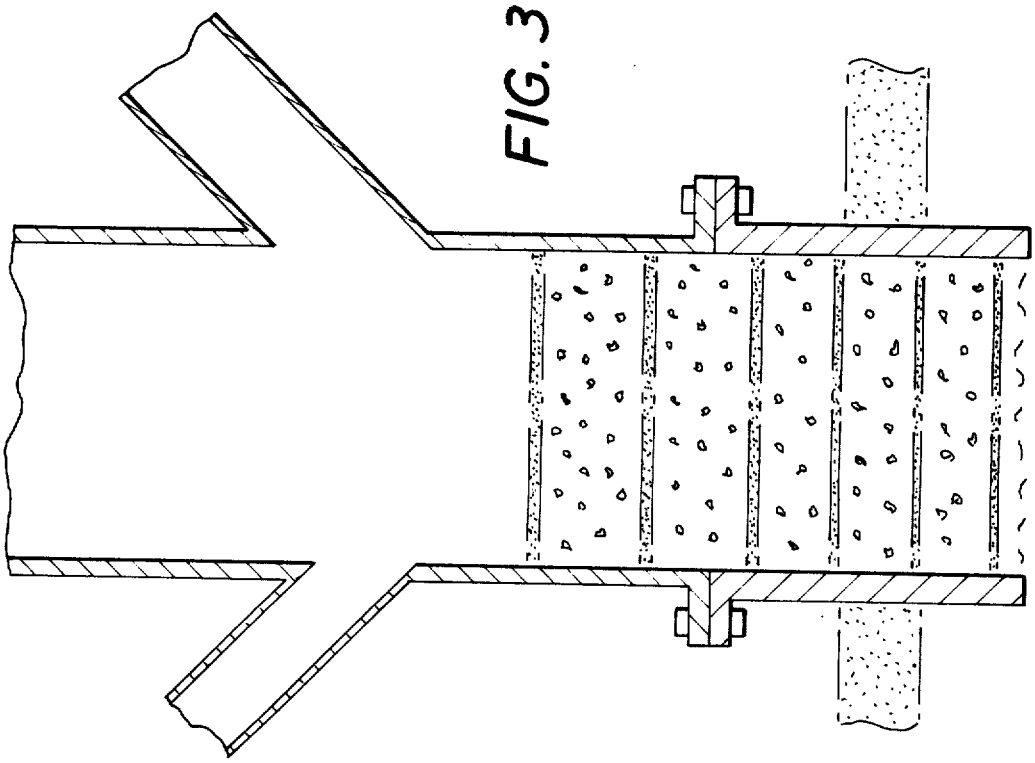

Feed tube 16 includes an additional aperture 62 formed therein at its upper end 44 in approximately the same area as the aperture 46 for the metal feed chute 48. Aperture 62 is in communication with a feed chute 64 which is of substantially identical construction to feed chute 48 and which may be used to supply carbon to the metal charge entering the feed tube 16 from chute 48. The supply of carbon through chute 64 may be simultaneous with the supply of metal chips to chute 16 so as to form a mixed charge, as shown in FIG. 2, or, alternatively, the supply of metal chips and carbon can be alternated to form layers of carbon between metal charges as seen in FIG. 3. In other embodiments of the invention it is contemplated that the carbon may be eliminated or it may be mixed with the metal chips before being supplied to the feed tube 16.

In any case, in the operation of the stoker feed mechanism of the present invention, the metal charge is supplied to feed tube 16 from chutes 48, to form a column of metal (e.g. a column of brass chips) 66 in tube 16. The carbon, if supplied in any of the previously discussed manners, preferably is in the form of carbon beads, and serves to prevent upward flow of gases from the furnace through the feed tube. Moreover, in the illustrative embodiment of the present invention, since brass chips are being melted the cooler carbon beads and metal chips in column 66 serve to condense zinc gases flowing up the feed tube from the substantially hotter molten bath. In this regard, it is noted that in the melting of brass chips, zinc from the chips is vaporized in the molten bath, which may have temperatures of 1700°F, and tends to flow up tube 16 for escape to the atmosphere. Where this occurs in previously proposed feed systems the zinc is lost as zinc oxide and the melt must be replenished with zinc during operation of the furnace so that the alloy produced therein has a consistent zinc content. With the present invention, on the other hand, by maintaining a column of metal chips in the feed tube above the melt, the zinc gases condense on the chips and carbon in the tube. In fact, it has been found that within two feet from the surface of the melt the temperature of the chips is sufficiently low to cause the zinc to condense thereon.

Thus, as the metal chips are supplied to the melt the previously vaporized zinc is returned to the furnace, thereby avoiding the need to recharge the furnace with zinc while maintaining a uniform composition of the alloy produced in the furnace.

It is noted that another feature of the present invention comprises the provision of a layer of carbon beads of substantial thickness, e.g. 10 inches, on top of the molten bath of metal 36. This layer of carbon beads will be relatively undisturbed during the feeding process, and will also serve to protect the metal against oxidation and to condense zinc produced in the molten bath and prevent it from rising from the top surface of the bath.

The extreme under end portion 70 of feed tube 16 contains a piston 72 slidably mounted therein. Piston 72 is used to stoke the metal and carbon charge into the furnace. The piston may be reciprocated in the feed tube in any convenient manner, as for example by a hydraulic or pneumatic ram or cylinder 74. In the illustrative embodiment of the invention shown in FIG. 1 of the drawing, ram 72 is a double acting air cylinder of conventional construction to which air is supplied through air lines 76, 78. The ram is mounted on the top end 70 of tube 16 by cooperating flanges 80, 82 on the ram and tube, which flanges are bolted together in any convenient manner. In addition, bracing arms (not shown) from frame 12 can be connected to these flanges to provide additional rigidity in the mounting structure of the cylinder.

Piston 72 is operatively connected to the piston 86 in cylinder 74 by a piston rod 88 in any convenient manner so as to be reciprocated upon operation of the cylinder. Of course, it is to be understood that other types of reciprocating devices can be used to move piston 72 in tube 16; for example, a reversible screw mechanism or mechanical crank and pitman linkage could also be utilized.

In either case piston 72 is actuated to reciprocate in tube 16 at predetermined intervals during the continuous feed of the charge, or between measured charges. The stroke of the piston is selected to move the charge downwardly in the tube 16 a predetermined distance, but it does not move the charge directly down into the furnace. In fact, as seen in FIG. 1 the stroke of piston 72 is such that it will move only to a point a short distance below charge openings 46 and 62 in feed tube 16. Thus, a column of the charge of predetermined height is built up in the tube 16 at the beginning of the feeding operation and each stroke moves only a portion Of the bottom section of the charge in the column into the furnace, while displacing the remainder of the column in the feed tube downwardly. Thus, the tube 16 remains substantially filled with the charge so as to condense gases flowing upwardly therein. In addition, piston 72, on its downward stroke, compresses the charge of metal and carbon bead in the tube, against the previously compressed charge therebelow and against the molten metal in the furnace.

In order to avoid excessive friction in the operation of piston 72 within tube 28, piston 72 may be provided with a sleeve of hard graphite material 90. In this connection, it is noted that the carbon beads supplied with the charges to the feed tube also tend to reduce friction in the tube between the tube and the piston and between the tube and the metal charge since some of the carbon beads will tend to smear on the inside surface of the feed tube. Moreover, some of the carbon beads will also tend to mix with the brass chips in the charge, before compression by the piston, and thus will reduce oxidation of the metal charge to minimize formation of dross at the bottom of the column of chips in tube 16 where the temperature is quite high.

Piston 72 may also be provided with a plurality of chip pusher rods 94 extending from the lower surface 92 thereof. These pusher rods may be formed of the same material as the piston and are connected thereto in any convenient manner, and may even be integrally formed with the piston, as desired. In any case, these chip pusher rods, because of their smaller total combined cross-section in relation to that of the feed tubes, prevent jamming of chips between the pusher ram and the feed tube.

The melting furnace 14 is provided with a molten metal discharge system which operates to maintain a relatively constant level of the molten metal within the furnace. This discharge system includes a discharge conduit or tube 98 which is mounted in a port 100 in the furnace wall in any convenient manner, and which includes a lower end 102 located adjacent to the bottom of the molten bath (see FIG. 1). Discharge tube 98 is inclined upwardly away from the furnace and has an upper end portion 104 located outside of the furnace adjacent to a molten metal transport system 106 of conventional construction. The end 104 of tube 98 is positioned at an elevation which is substantially equal to the desired level of metal in the furnace and, at an elevation which is above the elevation of the lower end 32 of tube section 30. In this manner, at the beginning of the melting operation, and during the continuance of the operation, the liquid level in the furnace must rise to the level 34, i.e. above the end 32 of the tube 30, before molten metal can be discharged from tube 98 since the metal will flow through the tube 98 only as a result of the pressure head of the molten metal within the furnace, i.e. the furnace and tube 98 act somewhat in the manner of a manometer. Thus, the end 32 of feed tube 16 remains submerged below the molten metal at all times during the operation of the furnace, thereby insuring that the metal charge is supplied from tube 16 directly into the molten metal in the furnace. As seen in the drawing, by continuously maintaining the molten metal level in the furnace above the lower end of the feed tube 16, the desired column of charge is maintained in the tube. If the discharge end of tube 98 were below the lower end of tube 16 the charge would simply fall through the tube and splash on the top of the molten surface or otherwise disturbing the layer of carbon beads placed thereon. Thus the desired column of charge could not be maintained in the feed tube.

Figure 4:
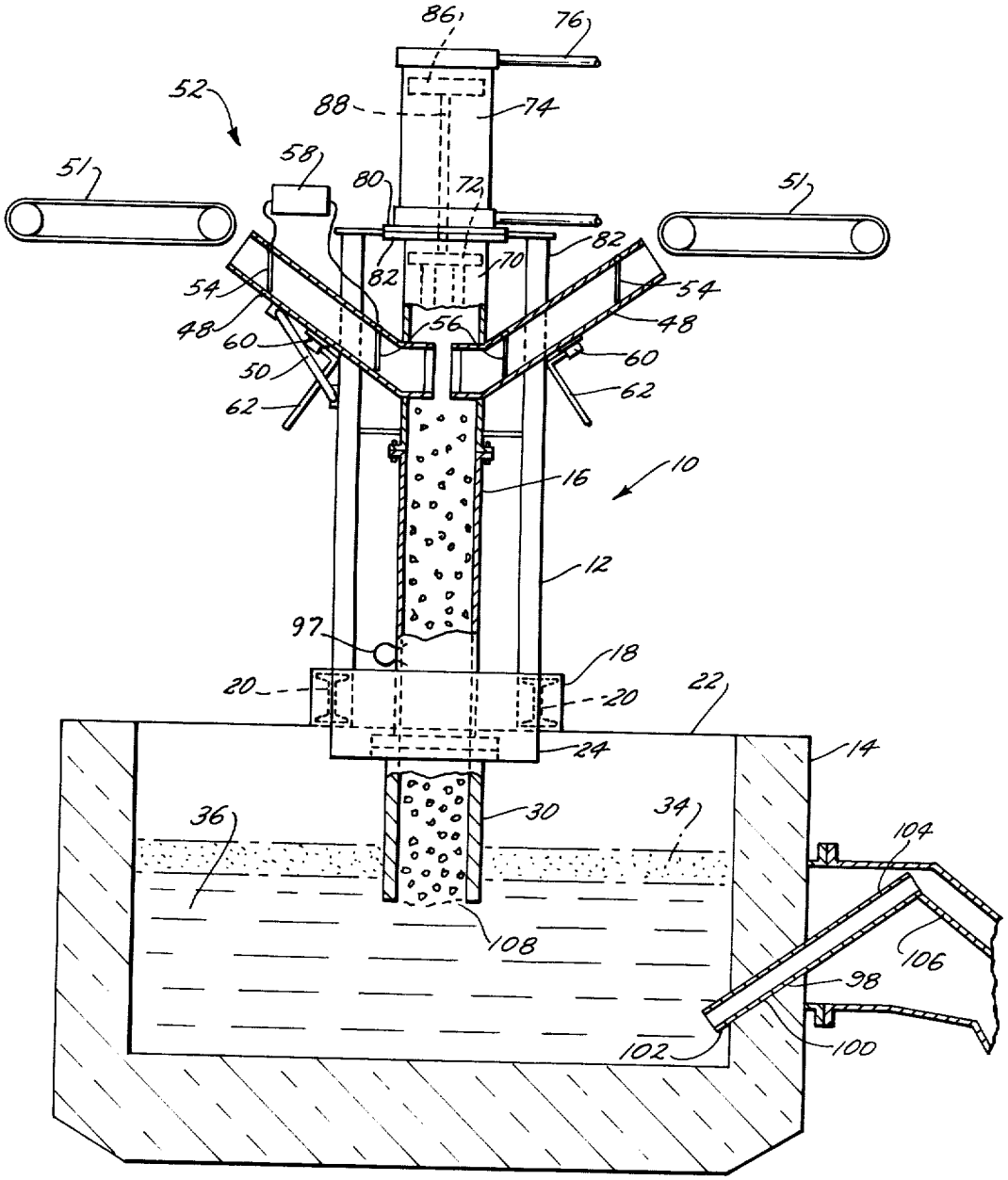
FIG. 4 is a view similar to FIG. 1 of another embodiment of the present invention.

Another embodiment of the present invention, in which intermittent measured metal charges are applied to a stoker feed tube, is illustrated in FIG. 4 of the drawing. In this embodiment, feed tube 16, furnace 14 and their associated frame elements are substantially identical to the furnace and frame described with reference to the embodiment of FIG. 1, and therefore like elements have been referenced with the same numerals, for convenience.

In the embodiment of the invention illustrated in FIG. 4, the charges of metal and carbon are supplied to the feed tube 16 successively, in order to form individual layers of carbon and measured charges of metal chips. Thus, as seen in FIG. 4, a gating system 52 is provided in association with the metal feed tubes 48. The gating system includes a pair of gates 54, 56 in each of the chutes 48, which chutes are controlled in any convenient manner by a central control system 58. With this arrangement, as metal is supplied to chutes 48, control system 58 keeps gates 56 closed until chutes 48 are filled, at which time gates 54 are closed to prevent the admission of further material to the chute. When a charge of metal is needed in feed tube 16 for supply to the furnace, gates 56 are open to supply the measured charge to the feed tube. After the supply of charge enters the tube, gates 56 are closed, gates 54 are opened, and chutes 48 are refilled. Of course, it is to be understood that other convenient gating or charge measuring systems which are adapted to supply a finite charge of metal to the feed tube through the chutes 48 secured thereto may be used.

In accordance with a feature of the present invention, chutes 48 are provided with air vibrator mechanisms 60 secured thereto on their lower surface, as seen in FIG. 4. These vibrators are preferably air actuated vibrators, such as any of the variety of types which are presently commercially available and which are supplied with air through air conduits 62 connected to a source of compressed air in the plant. The vibrators are operated when the charge in chutes 48 are to be supplied to feed tube 16, in order to insure that no charge sticks to the chutes, and/or remains therein.

Figure 5:
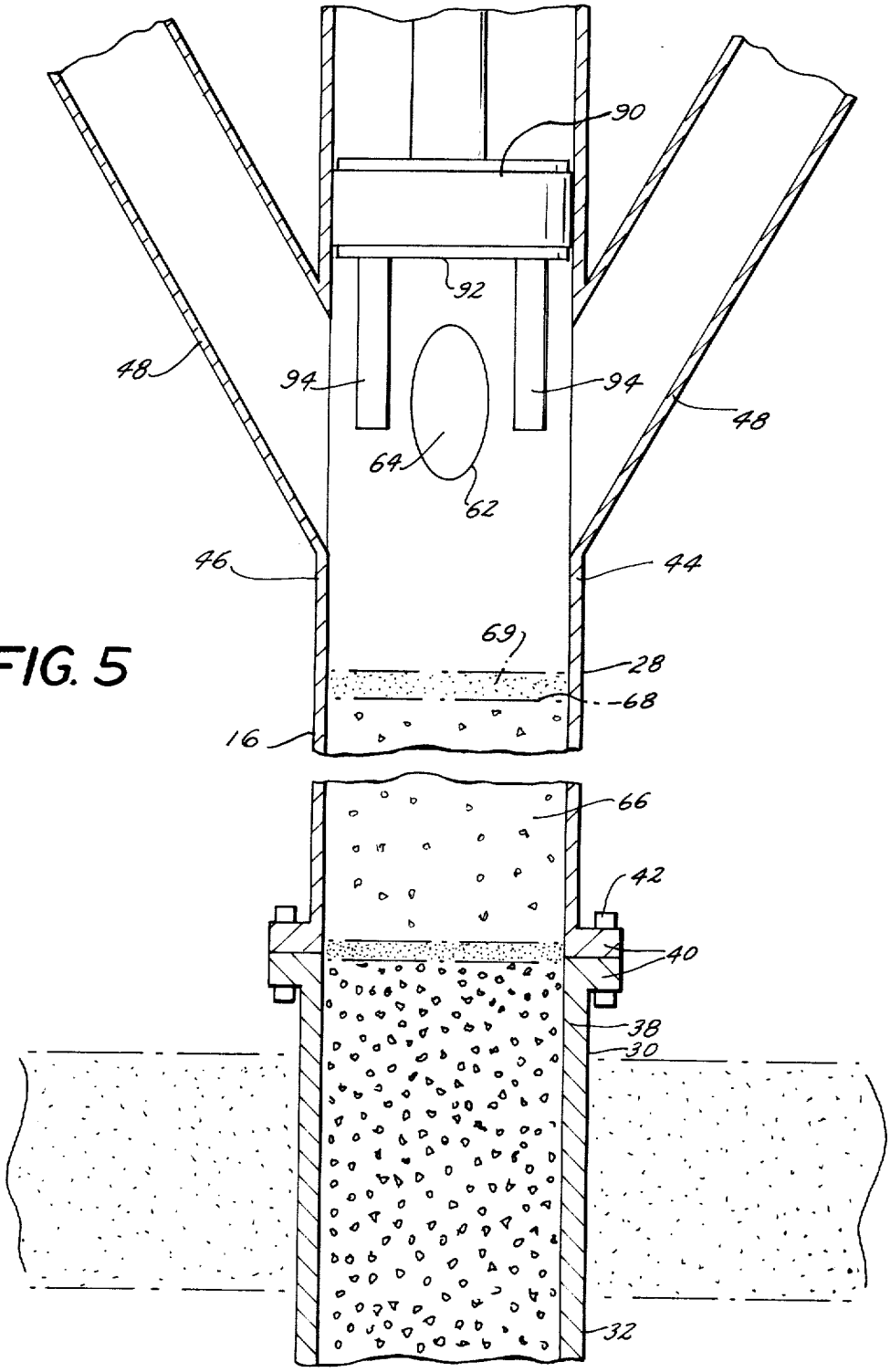
FIG. 5 is a partial schematic sectional view of the metal feed tube used in the stoker feed system illustrated in FIG. 4.

As seen in FIG. 5, feed tube 16 may also include an additional aperture 62 in communication with a feed chute 64. The latter is used to supply measured charge of carbon beads through a gating system, similar to that used with the chutes 48, to the top of each metal charge entering the feed tubes 16 from chutes 48. The supply of carbon through the gating system from chute 64 can be controlled in any convenient manner through control mechanism 58 and a detailed description of that control mechanism is not believed to be necessary herein.

By operating the embodiment of the invention of FIG. 4 with sequential measured charges of chips and carbon layers, column 66 of charge in tube 16 takes the configuration illustrated in FIGS. 3 and 5, wherein there are alternating compressed layers of charge and carbon. The furnace of FIG. 4 otherwise operates in the same manner as the furnace previously described in that the charge is supplied to the molten melt 36 at a level below the upper surface of the melt, the melt being covered by a layer of carbon beads or melt cover to prevent loss of gases from the top surface of the melt. Tube 16 thus has maintained therein, by the feed system of the invention, a continuous column of charge metal and/or carbon beads, which has a substantially lower temperature than the temperature of the melt in the furnace, so that zinc gases or vapors, and other gases, will condense on the metal chips and carbon beads in the feed tube and be returned to the melt during the operation of the melting process. Accordingly, these gases do not escape through the feed tube of the invention.

It is noted that even with the embodiment of FIG. 4, the carbon and metal charges can be supplied simultaneously, if desired, by properly modifying the control system 52, so that the beads and chips will mix as they form the vertical column in the feed tube. In addition, in either embodiment of the invention, the metal chips can be charged to the feed tube continuously, even while the piston of the stoker is cycling. Moreover, it is possible that the device of the invention can be operated without the addition of carbon beads, since in the treatment of certain metals, prevention of the formation of oxides can be achieved without the use of carbon beads.

In accordance with another feature of the invention, it is contemplated that in either of the embodiments illustrated in FIGS. 1 or 4, a reducing action can be effected by the introduction of a reducing gas such as a hydrocarbon gas (for example methane or propane) into the stoker feed tube at various levels below or above the top of the descending metal charge column. Such gases will reduce oxides on the metal chips that may be formed during the process in which the chips are created. A hydrocarbon gas, for example, propane, acts as a reducing agent and reduces the oxides on the metal chips. This can be achieved, for example, by the provision of a plurality of nozzles, e.g. the nozzle 97 schematically illustrated in FIG. 4, along the length of the feed tube 16 and connected to a supply of the appropriate gas. Introduction of an inert gas, such as nitrogen, into the stoker feed tube will tend to prevent oxidation of the metal in the descending column.

It is noted that the metal treated by the furnace may have a light coating of residual oil film thereon as a result of the process from which the metal chips are obtained. This residual oil film need not be removed from the metal chips prior to introduction into the furnace since, in accordance with a feature of the present invention and under the feeding action of the stoker system thereof, the residual oil film on the chips can be beneficial in the control or reduction of dross formation at the bottom of the feed tube.

Although the stoker feeding process of the present application has been particularly described herein with respect to the feeding of brass chips to the feed tube, it is also contemplated that the stoker feed system hereof is applicable to metals in substantially all other forms. For example, it is contemplated that virgin metals, processed metals such as rod, bar, wire, tube, strip, sheet, plate, extrusions, forgings and castings and scrap metal of all kinds can be supplied to a furnace by the stoker feed system of the present invention. Such feed materials may also be in other forms than chips, for example, cut, sheared, or sawed pieces or other particles, powder, clippings, extrusion butts, skeleton scrap, forging flash, machine parts and other commonly known forms. Moreover, mixtures of different solids and mixtures of solids and chips can be effectively charged by the stoker feeding system.

Accordingly, it is seen that a relatively simply constructed stoker feed system is provided for supplying metal (e.g. brass chips) to a furnace. By the construction of the invention the entire stoker feed system can be readily removed from the furnace 14 by a crane for maintenance as necessary and at the termination of operation in that furnace for repair or use at another furnace. The system serves to condense zinc vapor produced in the molten mass of the furnace, thereby preventing the escape of the zinc from the melting operation and returning the zinc to the furnace. If desired, tube 16 can be provided with a water cooling system to reduce the temperatures thereof, particularly in the lower tube 30, in any convenient manner. Moreover, inert or reducing gases can be supplied to the feed tube 16 to assist in the operation of furnace 14. The gases can also be supplied to the tube in any convenient manner such as for example by hose or pipe connections made to the tube in the area of the feed supply chutes 48.

Although illustrative embodiments of the present invention have been described herein in connection with the accompanying drawings, it is to be understood that the invention is not limited to those precise embodiments and that various changes and modifications may be effected therein by one skilled in the art without departing from the scope or spirit of this invention.

What is claimed is:

1. A stoker feed system for supplying metal to a electrical induction melting furnace, said stoker feed system comprising a generally vertically extending feed tube having opposed upper and lower end portions, with the lower end portion thereof being submerged below the upper surface of molten metal in said induction furnace; at least one feed chute communicating with said feed tube adjacent the upper end portion thereof for supplying a charge to said feed tube for maintaining a column of metal in said feed tube above the upper surface of said molten metal in said furnace during operation thereof; means in said feed tube for compressing said metal in said feed tube and for moving the metal column in the feed tube downwardly in the tube to push the lower portion of the metal column in the feed tube into the molten mass in said induction furnace while maintaining the height of the compressed column of metal in the feed tube within a predetermined height range to allow condensation on the metal column in the feed tube of undesirable gases flowing up the feed tube from the furnace, and a molten metal discharge conduit operatively connected to said furnace, said conduit having a first end portion located in direct communication with said furnace adjacent the bottom of the melting furnace and a second end portion located outside of the furnace at a higher elevation than said first end portion of the discharge conduit and the lower end portion of the feed tube, thereby to provide direct discharge of molten metal from the furnace while automatically and independently maintaining a relatively constant molten metal level in said induction furnace above the lower end portion of the feed tube during operation thereof.

2. The feed system as defined in claim 1 wherein said feed tube comprises a pair of axially aligned and operatively interconnected tube sections with one of said tube sections defining the lower end portion of the feed tube; said one tube section being formed of a metal alloy of greater resistance to erosive attack by the molten metal in the furnace than the other of said tube sections.

3. The feed system as defined in claim 2 including a frame removably mounted on said induction furnace; said feed tube being mounted on said frame whereby the entire feed system may be removed from said induction furnace.

4. The feed system as defined in claim 1 wherein said compressing and moving means includes a reciprocating piston located in said feed tube, and means for reciprocating said piston in said tube above the level of molten metal in the furnace along a predetermined stroke length from a starting position adjacent the upper end of said feed tube, and above the level of said one feed chute, to a stopping position adjacent the lower end of the feed tube and above the level of molten metal in the furnace.

5. The feed system as defined in claim 4 wherein said piston has substantially the same diameter as said feed tube and includes a plurality of spaced chip pusher rods operatively connected to the piston and extending downwardly therefrom towards the lower end of the feed tube.

6. The feed system as defined in claim 5 including at least one other feed chute communicating with said feed tube adjacent the upper portion thereof for supplying a layer of carbon to said feed tube between charges of metal.

7. The feed system as defined in claim 6 wherein said chute for supplying metal to the feed tube supplies brass chips and said chute for supplying a layer of carbon supplies carbon beads.

8. The feed system as defined in claim 7 including a layer of carbon beads on the upper surface of the metal in said furnace.

9. The feed system as defined in claim 7 including a second feed chute communicating with said feed tube adjacent the upper end portion thereof for supplying carbon beads to the tube and means for vibrating said chutes to improve the flow of metal and carbon beads therein.

10. The feed system as defined in claim 7 wherein said metal comprises brass chips and said system includes gate means in said chute for delivering a finite predetermined amount of brass chips and carbon beads to said feed chute.

11. The feed system as defined in claim 3 wherein said piston includes an annular graphite sleeve.

* * * * *